US008221070B2

(12) United States Patent
Baryshnikov

(10) Patent No.: US 8,221,070 B2
(45) Date of Patent: Jul. 17, 2012

(54) CENTRIFUGAL IMPELLER WITH CONTROLLED FORCE BALANCE

(75) Inventor: Dmitriy Baryshnikov, Rockford, IL (US)

(73) Assignee: Woodward, Inc., Fort Collins, CO (US)

( * ) Notice: Subject to any disclaimer, the term of this patent is extended or adjusted under 35 U.S.C. 154(b) by 621 days.

(21) Appl. No.: 12/411,029

(22) Filed: Mar. 25, 2009

(65) Prior Publication Data

US 2010/0247313 A1 Sep. 30, 2010

(51) Int. Cl.
*F04D 29/22* (2006.01)

(52) U.S. Cl. ..... 415/206; 415/104; 415/106; 415/185

(58) Field of Classification Search ..... 416/185, 416/188, 181, 183, 186 R; 415/203, 206, 415/104, 106

See application file for complete search history.

(56) References Cited

U.S. PATENT DOCUMENTS

| | | | | |
|---|---|---|---|---|
| 3,637,329 | A | 1/1972 | Sato et al. | |
| 3,652,186 | A | 3/1972 | Carter | |
| 3,746,461 | A | 7/1973 | Yokota et al. | |
| 3,918,852 | A | 11/1975 | Carter | |
| 4,739,777 | A | 4/1988 | Nelson | |
| 4,867,633 | A | 9/1989 | Gravelle | |
| 4,890,980 | A | 1/1990 | Heald et al. | |
| 5,061,151 | A | 10/1991 | Steiger | |
| 6,074,167 | A * | 6/2000 | Olifirov et al. | 415/131 |
| 6,135,728 | A | 10/2000 | Klein et al. | |
| 6,193,462 | B1 | 2/2001 | Kubota | |
| 6,419,450 | B1 * | 7/2002 | Lum | 416/186 A |
| 7,234,657 | B2 * | 6/2007 | Doering et al. | 241/55 |
| 8,025,479 | B2 * | 9/2011 | Scott | 415/206 |
| 2002/0037215 | A1 | 3/2002 | Choi et al. | |
| 2005/0071998 | A1 | 4/2005 | Rocky et al. | |
| 2006/0263200 | A1 | 11/2006 | Ahlroth et al. | |
| 2007/0292283 | A1 | 12/2007 | Oklejas | |
| 2010/0284812 | A1 * | 11/2010 | Zahdeh | 416/185 |

FOREIGN PATENT DOCUMENTS

| | | |
|---|---|---|
| JP | 59-097734 A | 6/1984 |
| WO | WO 90/07650 | 7/1990 |
| WO | WO 00/66893 | 11/2000 |

* cited by examiner

*Primary Examiner* — Gary F. Paumen
(74) *Attorney, Agent, or Firm* — Reinhart Boerner Van Deuren P.C.

(57) ABSTRACT

An impeller for a centrifugal pump that includes a disk-shaped shroud having a central axis, a front surface, a rear surface, and a circular perimeter, and a hub at the center of the shroud, the hub having an axial bore. The impeller further includes a first set of vanes on the front surface of the shroud, the first set of vanes extending radially inward from the perimeter towards the hub, a second set of vanes on the rear surface of the shroud, the second set of vanes extending radially inward from the perimeter towards the hub, a balancing area on the rear surface of the shroud, the balancing area extending radially outward from the hub, and a number of openings in the shroud, the number of openings configured to allow a fluid to pass from one side of the shroud to the other.

30 Claims, 10 Drawing Sheets

CENTRIFUGAL IMPELLER WITH CONTROLLED FORCE BALANCE

BACKGROUND OF THE INVENTION

This invention relates to centrifugal pumps generally, and more particularly to impellers for centrifugal pumps.

An impeller is a rotating component of a centrifugal pump which transfers energy from the power source that drives the pump to the fluid being pumped by accelerating the fluid outward from the center of rotation. The velocity of the impeller translates into pressure when the output movement is confined by the pump casing. Typically, an impeller includes a central hub or eye which is positioned at the pump inlet, and a plurality of vanes to propel the fluid radically. The central hub typically includes an axial bore or opening which may be splined to accept a splined driveshaft.

One of the major challenges of centrifugal pump design is dealing with axial loads. Generally, due to a large cross-sectional area of the impeller, a relatively small pressure differential across the impeller can translate into high axial loads on the pump's thrust bearing. The high axial loads can cause premature pump failure and frequent component replacement. As a result, large and expensive thrust bearings may be employed to handle the axial loads.

Several methods have been tried to reduce the effects of axial loading. These include the use of impellers with front and rear shrouds to fully enclose the impeller vanes, and of double-sided impellers. However, these impeller types do not typically provide a mechanism to counterbalance plug load—the hydraulic pressure load from the pump inlet, or other axial loads that are applied to the pump driveshaft.

Other methods for reducing axial loading include use of impellers with back pump-out vanes and impellers with labyrinth seals. However, these types of impellers are very sensitive to axial clearances. A slight change in axial clearance may significantly upset the axial force balance of an impeller with back pump-out vanes. Impellers with labyrinth seals can see significantly degraded performance due to high leakage variation caused by small changes in axial clearance. Reducing the sensitivity of these impellers to axial clearance may involve costly and complex design changes that increase the weight and reduce the reliability of the pump.

It would therefore be desirable to have a centrifugal pump impeller that effectively balances axial loads including plug loads, is not significantly affected by changes in axial clearance, and which does not require costly or complex design features that increase the weight and reduce the reliability of the pump.

Embodiments of the invention provide such an impeller. These and other advantages of the invention, as well as additional inventive features, will be apparent from the description of the invention provided herein.

BRIEF SUMMARY OF THE INVENTION

In one aspect, embodiments of the invention provide an impeller for a centrifugal pump that includes a disk-shaped shroud having a central axis, a front surface, a rear surface, and a circular perimeter, and a hub at the center of the shroud, the hub having an axial bore. The impeller further includes a first set of vanes on the front surface of the shroud, the first set of vanes extending radially inward from the perimeter towards the hub, a second set of vanes on the rear surface of the shroud, the second set of vanes extending radially inward from the perimeter towards the hub, a balancing area on the rear surface of the shroud, the balancing area extending radially outward from the hub, and a number of openings in the shroud, the number of openings configured to allow a fluid to pass from one side of the shroud to the other.

In another aspect, embodiments of the invention provide a centrifugal pump that includes a driveshaft configured to be rotated, and a pump casing. The pump casing includes an inlet, an outlet, and a chamber disposed between the inlet and outlet. The centrifugal pump further includes an impeller disposed in the pump casing and attached to the driveshaft, the impeller comprising a circular shroud having an central axis, a front surface, a rear surface, and a circular perimeter, and an eye at the center of the shroud, the eye having an axial bore. Additionally, the pump has a first set of vanes on the front surface of the shroud, the first set of vanes extending radially inward from the perimeter towards the hub, a second set of vanes on the rear surface of the shroud, the second set of vanes extending radially inward from the perimeter towards the hub, a balancing region on the rear surface of the shroud, the balancing region extending radially outward from the hub, and a number of openings in the shroud, the number of openings configured to allow a fluid to pass from one side of the shroud to the other.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
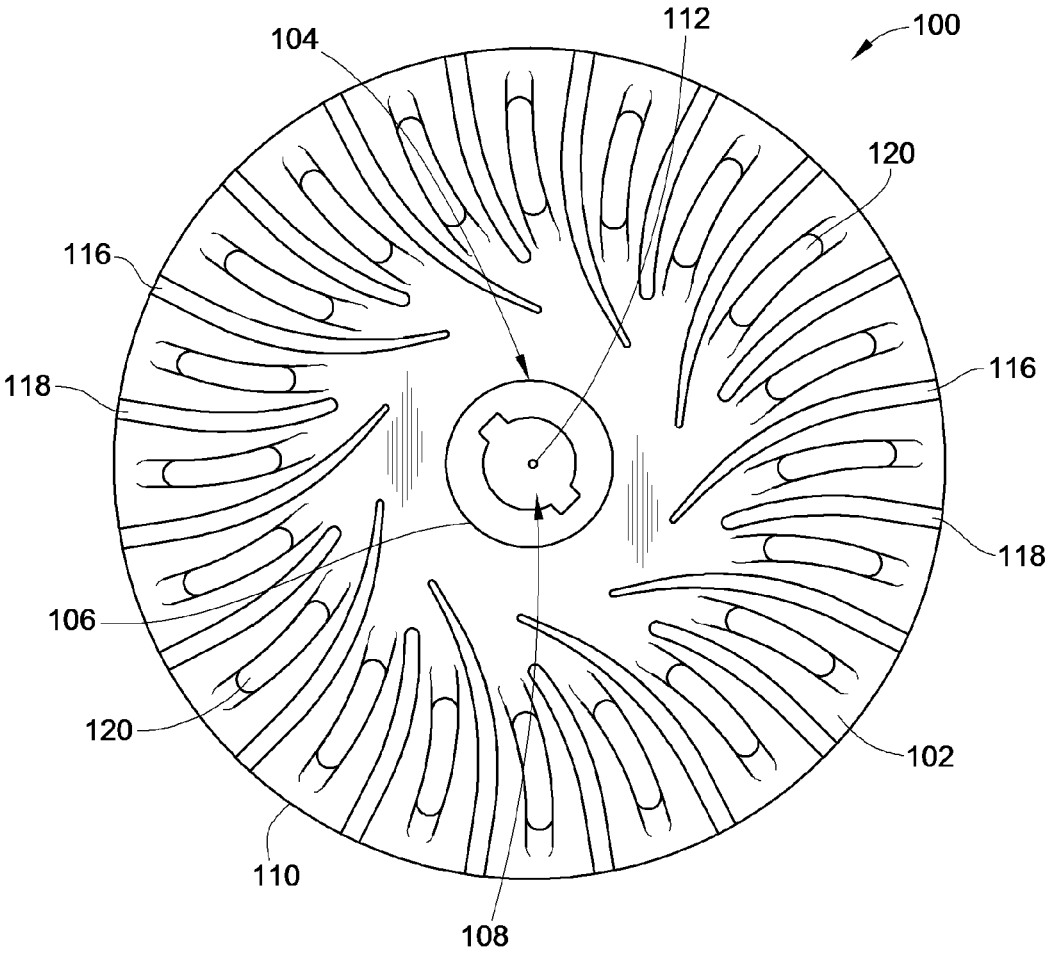
FIGS. 1, 2 and 3 are front, side and rear views of an impeller according to an embodiment of the invention.
Figure 2:
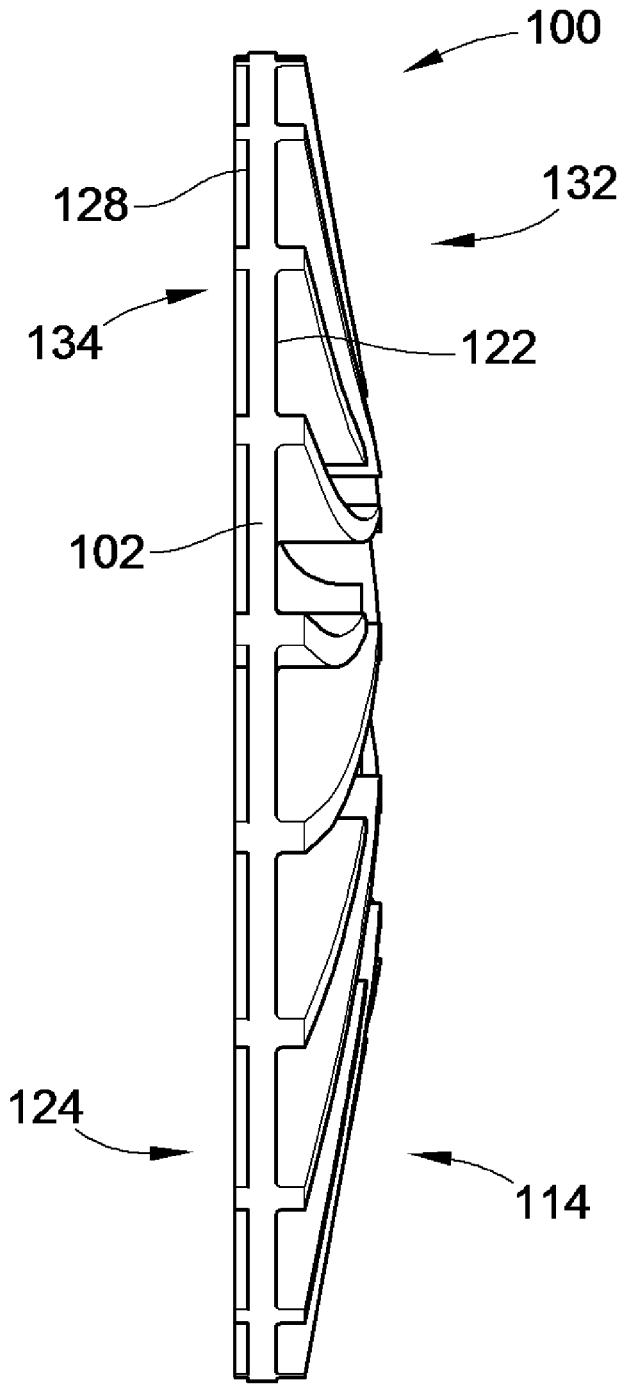
Figure 3:
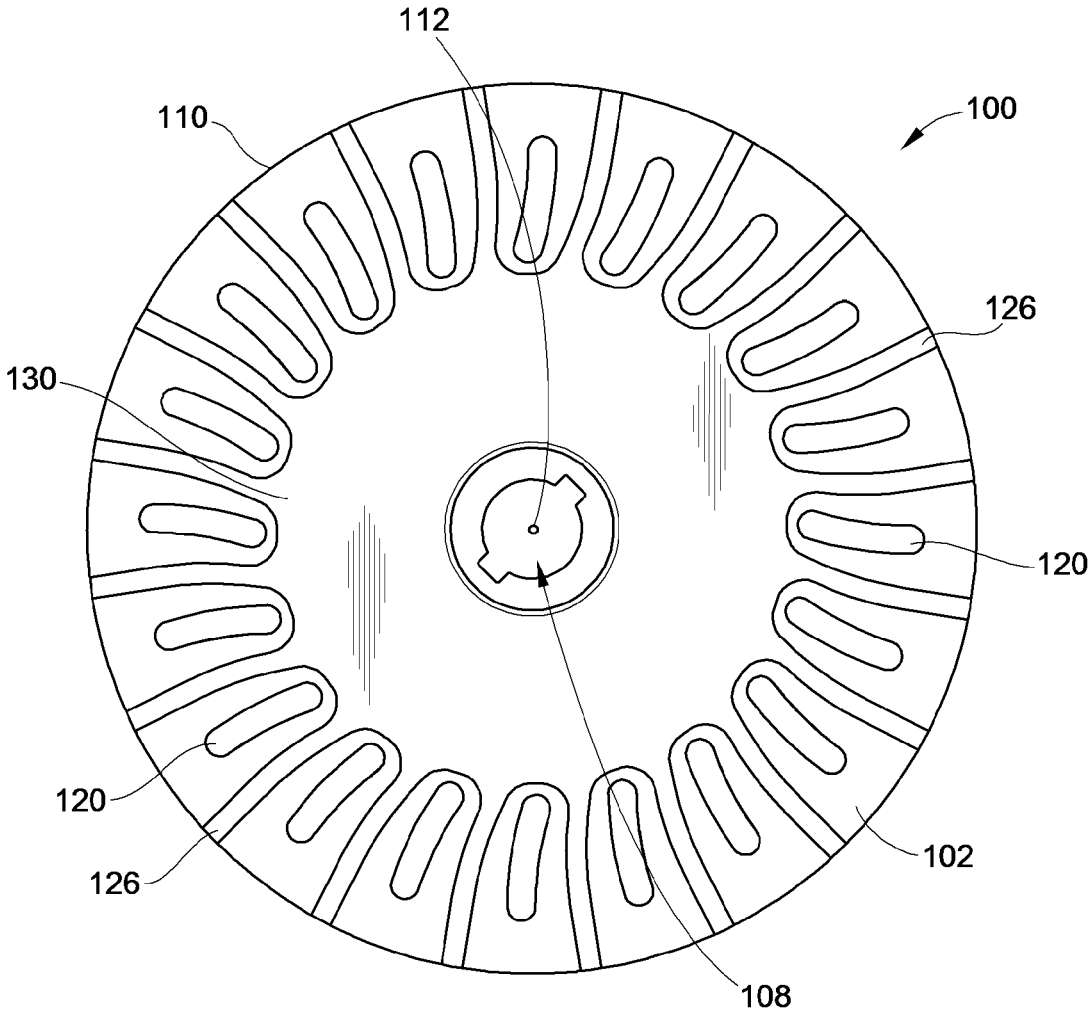

FIGS. 1, 2 and 3 illustrate an impeller 100 for a centrifugal pump, according to an embodiment of the invention. Impeller 100 is a double sided semi-opened type impeller, i.e., having a single disk-shaped shroud 102 and a central hub or eye 104. The hub 104 has a curved profile 106 and an axial bore or opening 108. The axial bore 108 may be keyed or splined to accept a keyed or splined driveshaft. The shroud 102 is integral with the hub 104 and extends radially outward from the hub 104. The shroud 102 has a circular perimeter 110 whose radius extends from an axis 112 at the center of the axial bore 108. Typically, the hub 104 is positioned at the pump inlet such that, when a fluid from the inlet flows axially towards the hub 104 of the impeller 100, the curved profile 106 changes the direction of fluid flow from an axial direction to a radial direction.

The front side 114 of the impeller 100 includes a set or plurality of curved long vanes 116 and a plurality of curved short vanes 118, both types convexly curved in the direction of rotation. Each of the pluralities of curved vanes 116, 118 extends from the perimeter 110 inward towards the hub 104. The series of long curved vanes 116 alternates with the series of short curved vanes 118, both of which are evenly spaced around the circumference of the impeller 100. The long vanes 116 extend substantially closer to the hub 104 than the short vanes 118. Between each adjacent long vane 116 and short vane 118, there is a curved slotted hole or opening 120 in the shroud 102. In one embodiment of the invention, the slotted openings 120 extend radially inward towards the hub 104 terminating at roughly the same distance from the axis 112 as the short vanes 118. The slotted openings 120 extend radially outward towards the perimeter 110. In alternate embodiments, the length and width of the slotted openings 120 can be varied depending on the anticipated axial load across the outer portions of the impeller 100. Generally, the greater the anticipated axial load across the outer portions of the impeller 100, the larger the slotted openings 120 need to be to balance the anticipated axial loads. In an embodiment of the invention, the openings 120 are chamfered to reduce hydraulic losses as the fluid moves through the openings 120. The chamfer may be on one side so that the openings 120 are larger on one side of the impeller 100 than on the other. Alternatively, there may be a chamfer on both sides of the impeller openings 120.

The long vanes 116 and short vanes 118 extend to some height in a direction substantially orthogonal to the front surface 122 of the shroud 102. The vanes 116, 118 rise to their maximum height at the point were the vanes 116, 118 are closest to the axis 112. From this maximum, the height of the vanes 116, 118 decreases as they extend radially towards the perimeter 110 giving the vanes 116, 118 a straight or linear tapered profile with the minimum height for all vanes 116, 118 at the perimeter 110. In an alternate embodiment of the invention, a profile of the vanes is that of a curved taper rather than a straight or linear taper. The width of the vanes can also vary with distance from the axis 112. In the embodiment of FIG. 1, each of the vanes 116, 118 is narrowest at the point closest to the axis 112. The width of the vanes 116, 118 increases, as the vanes extend toward the perimeter 110. In an embodiment of the invention, the vanes 116, 118 reach a maximum width at a point inside the perimeter 110.

The back side 124 of the impeller 100 includes the slotted holes 120 and a plurality of curved rear vanes 126 which extend to some height in a direction substantially orthogonal to the rear surface 128 of the shroud 102. The height of the rear vanes 126 is significantly less than the height of the front side vanes 116, 118. The back side 124 further includes a balancing region or balancing area 130 located between the hub 104 and the slotted openings 120. The size of the balancing area 130 is effectively determined by the proximity of the slotted openings 120 to the hub 104. During pump operation, fluid from the inlet establishes a pressure on the balancing region or area 130. The force of that pressure is determined by the diameter, and therefore the surface area, of the balancing region 130. The pressure-induced force on the balancing area 130 acts as a piston, providing an opposing axial force to counterbalance the force from the plug load acting on the pump driveshaft. The desired counterbalancing force may be obtained by properly choosing the diameter of the balancing area 130 which, in turn, is chosen by determining the inward extension for the slotted openings 120 that yields the desired diameter.

In operation, the impeller 100 is configured to propel fluid from the inlet flowing axially towards the hub 104 radially outward to the pump inlet. The curved vanes 116, 118 on the front side 114 of the impeller 100, and the rear vanes 126 on the back side 124 of the impeller 100, are configured to efficiently propel fluid to the pump outlet with minimal leakage. The slotted openings 120 allow fluid to flow freely between a front face 132 and a rear face 134 of the impeller 100, thus equalizing the pressure on both faces 132, 134 of the impeller 100 during pump operation. As mentioned above, those axial forces resulting from plug load at the pump inlet are balanced by the pressure-induced forces on the balancing area 130.

This balancing of the various axial loads allows the impeller 100 to be employed without large, expensive axial thrust bearings. The impeller 100 can be made lighter, less expensively than fully shrouded impellers, and without complex, costly dynamic seals. Further, the impeller 100 has low internal leakage and is insensitive to changes in axial clearance.

Figure 4:
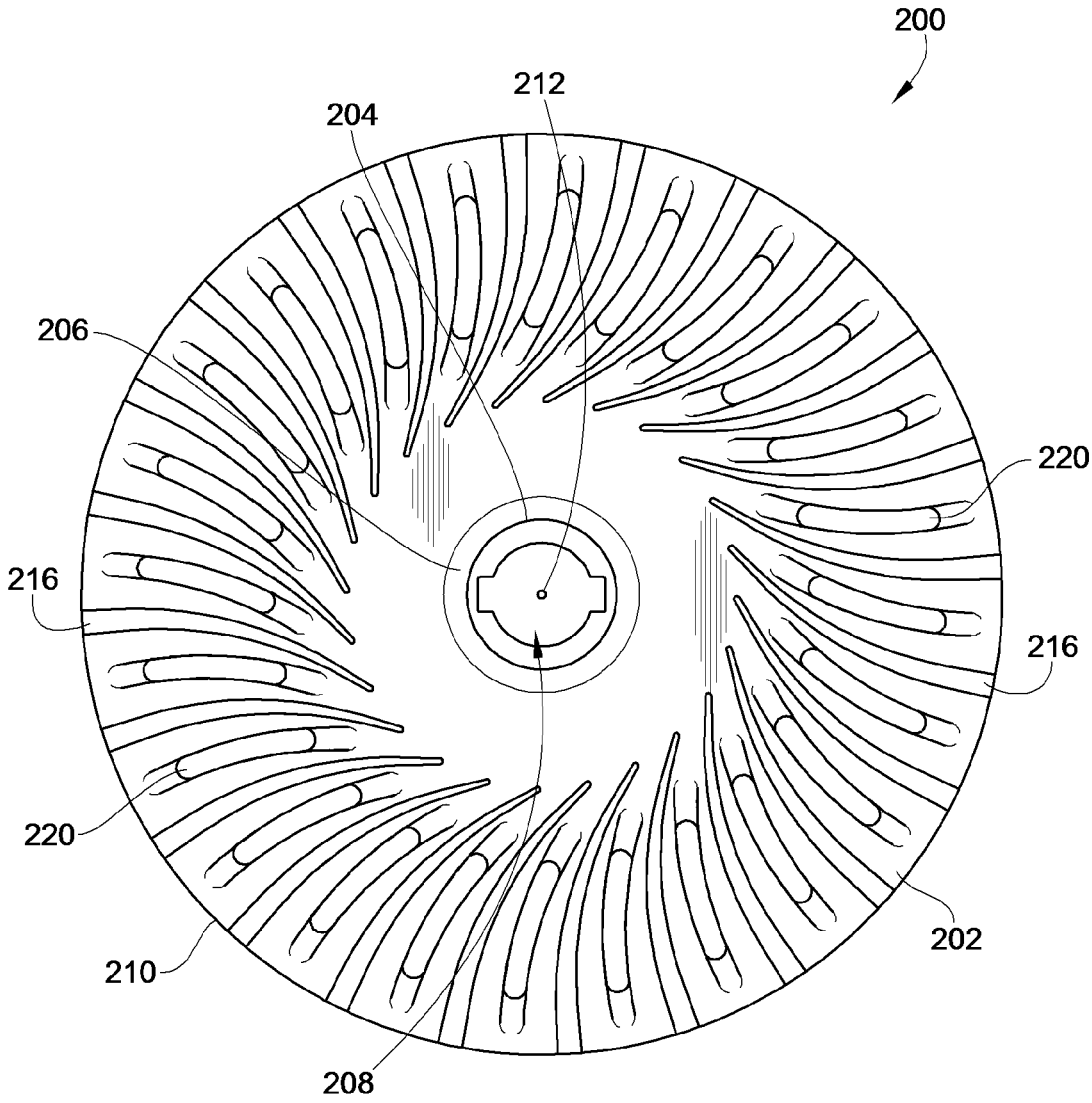
FIGS. 4, 5 and 6 are front, side and rear views of an impeller according to an alternate embodiment of the invention.
Figure 5:
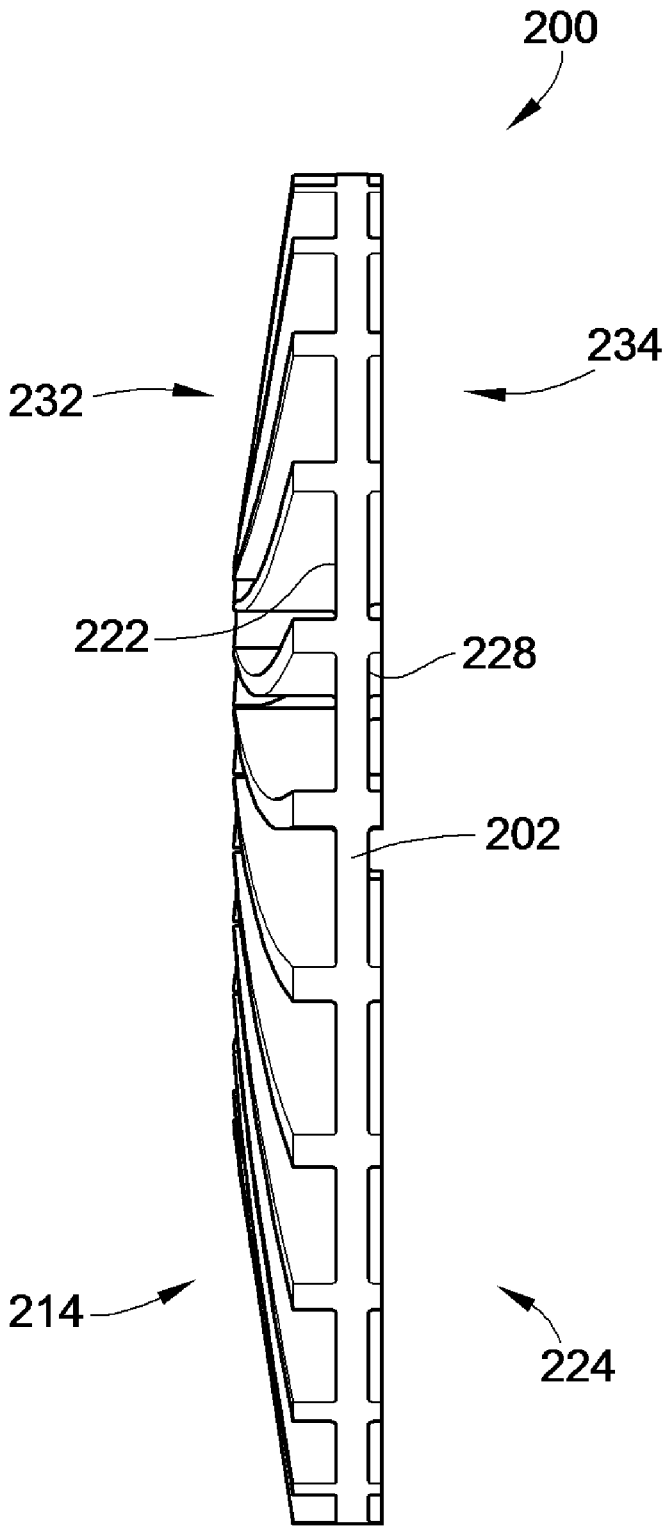
Figure 6:
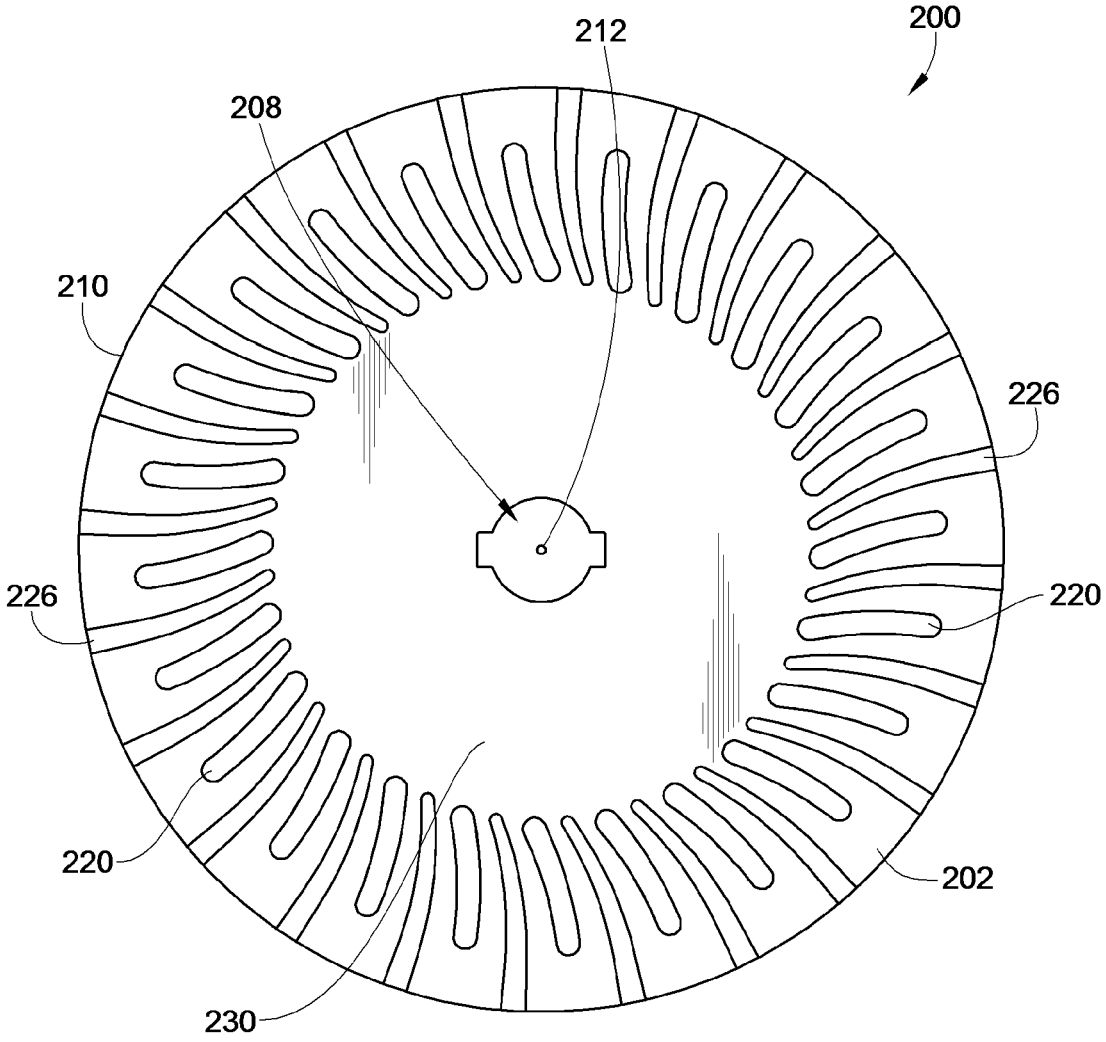

FIGS. 4, 5 and 6 illustrate an impeller 200 according to an embodiment of the invention. The impeller 200 includes a shroud 202, and a hub 204 having a curved profile 206 and an axial bore 208, which can be keyed or splined. The impeller 200 is similar in most respects to the above described impeller 100, except that a plurality of curved vanes 216 on a front side 214 are all of the same length. Each of the vanes 216 extends to within the same distance of an impeller axis 212. Between each pair of adjacent vanes 216 is a curved slotted opening 220 that extends radially inward towards the hub 204. The inward extension of the slotted openings 220 terminates farther from the axis 212 then the inward extension of the vanes 216. The slotted openings 220 also extend radially outward in the direction of a circular perimeter 210. In an embodiment of the invention, the slotted openings 220 are chamfered to reduce hydraulic losses as the fluid moves through the slotted openings 220. The chamfer may be on one side so that the slotted openings 220 are larger on one side of the impeller 200 than on the other. Alternatively, there may be a chamfer on both sides of the slotted openings 220.

The vanes 216 extend to some height in a direction substantially orthogonal to a front surface 222 of the shroud 202. The height of the vanes 216 tapers in a straight line from its maximum at the point closest to the axis 212 to the minimum at perimeter 210. In the embodiment of FIG. 4, each of the vanes 216 is narrowest at the point closest to the axis 212. The width of the vanes 216 generally increases as the vanes extend toward the perimeter 210. In an embodiment of the invention, the vanes 216 reach a maximum width at a point inside the perimeter 210.

A back side 224 of the impeller 200 includes a plurality of curved rear vanes 226, the plurality of slotted holes 220 and a balancing region or area 230 whose diameter, and surface area, is effectively determined by the inward extension of the slotted openings 220. The rear vanes 226 extend to some height in a direction substantially orthogonal to a rear surface 228 of the shroud 202. The height of the rear vanes 226 is significantly less than the height of the front side 214 vanes 216. In operation, impeller 200 behaves much like the aforementioned impeller 100. Pressure established on the balancing area 230 acts as a piston, the force of which counterbalances the hydraulic plug load from the pump inlet.

Figure 7:
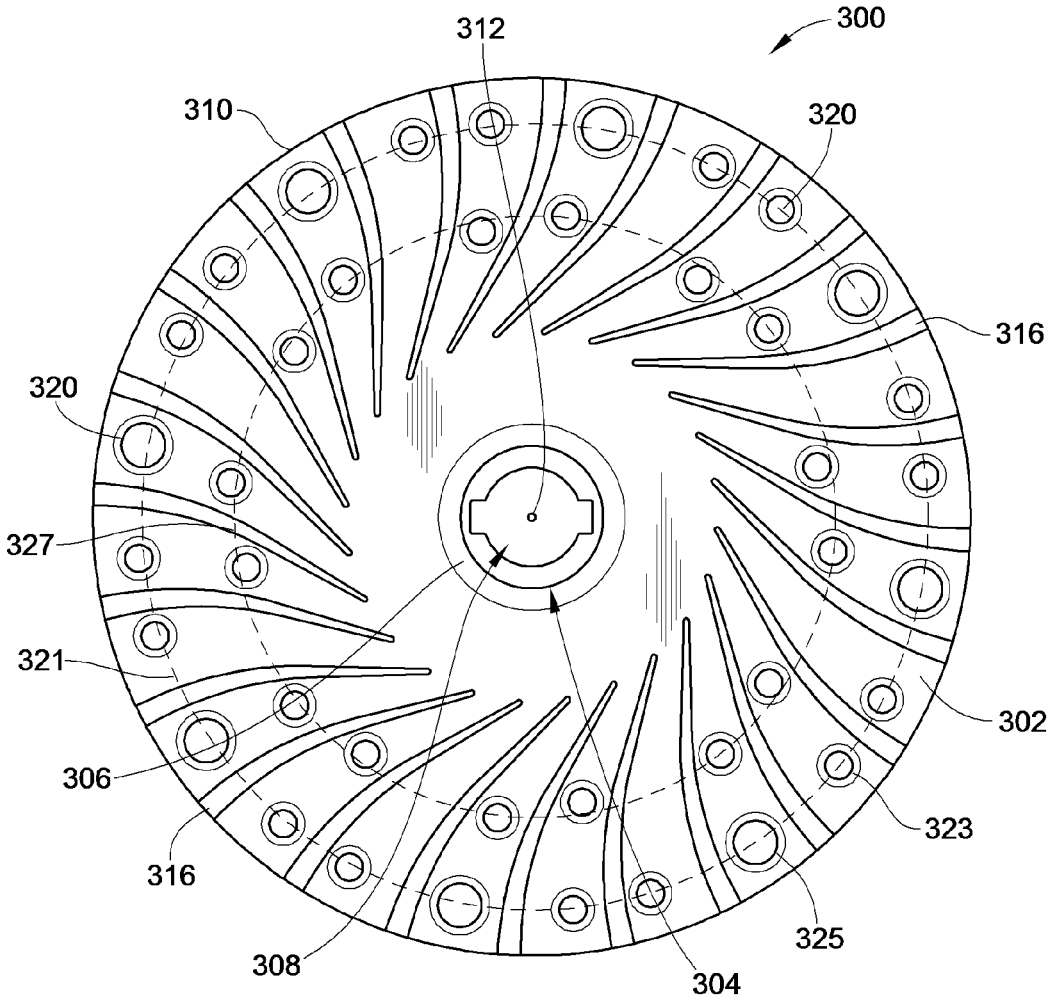
FIGS. 7, 8 and 9 are front, side and rear views of an impeller according to an alternate embodiment of the invention.
Figure 8:
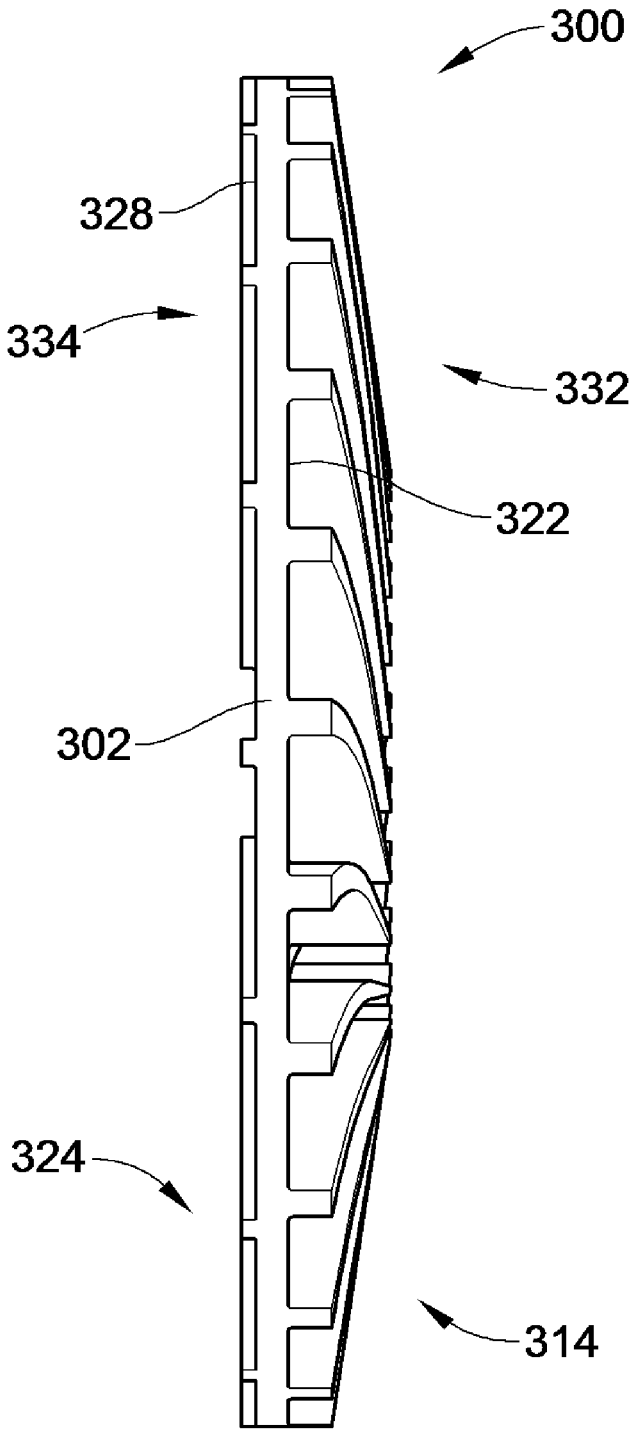
Figure 9:
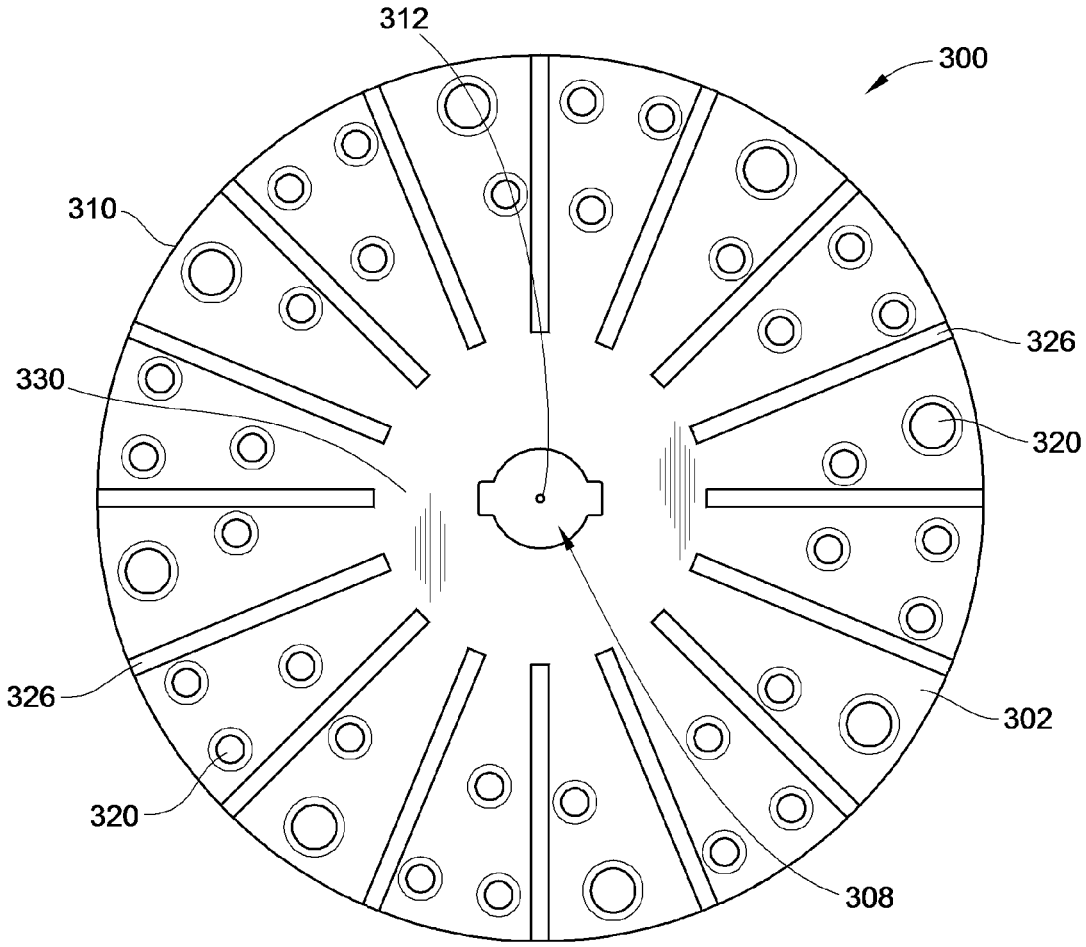

FIGS. 7, 8 and 9 illustrate an impeller 300 according to an embodiment of the invention. Impeller 300 includes a single disk-shaped shroud 302, and a central hub 304 with a curved profile 306 and an axial bore 308, which can be keyed or splined. The impeller 300 has a circular perimeter 310, an axis 312 at the center of the axial bore 308, and a plurality of curved vanes 316 on a front side 314. Evenly spaced around the circumference of the impeller 300, the curved vanes 316 are all of the same length, extending radially inward from a circular perimeter 310 towards the hub 304, each terminating at the same distance from the axis 312.

Impeller 300 includes a plurality of circular openings or holes 320, one or two of which is disposed between each pair of adjacent vanes 316. The plurality of holes 320 can be divided into two groups. The first group of a plurality of holes 320 is spaced about the circumference of the impeller 300 located in an outer region 321 close to the perimeter 310. The holes in the first group include a number of small holes 323 and a number of large holes 325, the number of large holes 325 being half the number of small holes 323. In an embodiment of the invention, the circular openings 320 are chamfered to reduce hydraulic losses as the fluid moves through the circular openings 320. The chamfer may be on one side so that the circular openings 320 are larger on one side of the impeller 300 than on the other. Alternatively, there may be a chamfer on both sides of the circular openings 320.

The second group of the plurality of holes 320 is spaced about the circumference of the impeller 300 and located in an inner region 327 closer to the axis 312 then the outer region 321 for the first group. In one embodiment of the invention, the number of holes in the second group is two-thirds the number of holes in the first group. Though in alternate embodiments of the invention, the ratio of the number of holes in the second group to the number of holes in the first group may be greater or lesser than two thirds.

The curved vanes 316 extend to some height in a direction substantially orthogonal to the front surface 322 of the shroud 302. As is in the previous embodiments, the height of the vanes 316 is maximum at the point closest to the axis 312 and tapers to its minimum height at the perimeter 310. In the embodiment of FIG. 7, each of the vanes 316 is narrowest at the point closest to the axis 312. The width of the vanes 316 generally increases as the vanes extend toward the perimeter 310. In an embodiment of the invention, the vanes 316 reach a maximum width at a point inside the perimeter 310.

The back side 324 of the impeller 300 includes a plurality of rear vanes 326 extending radially from the perimeter 310 inward towards the hub 304. In the embodiment shown, the rear vanes 326 are straight. In another embodiment, the rear vanes could be curved. The rear vanes 326 extend to some height in a direction substantially orthogonal to a rear surface 328 of the shroud 302, though to a significantly shorter height than the vanes 316. Between each pair of adjacent rear vanes 326, there are one or two holes of the plurality of holes 320.

The back side 324 includes a balancing region or area 330 defined by the space between the hub 304 and the rear vanes 326. In operation, impeller 300 functions like the above-described impellers 100, 200. The plurality of holes 320 balances the pressure across the front and rear faces 332, 334 of the impeller 300. During pump operation, pressure-induced forces acting on the balancing area 330 counteract axial forces from plug load at the pump inlet.

Figure 10:
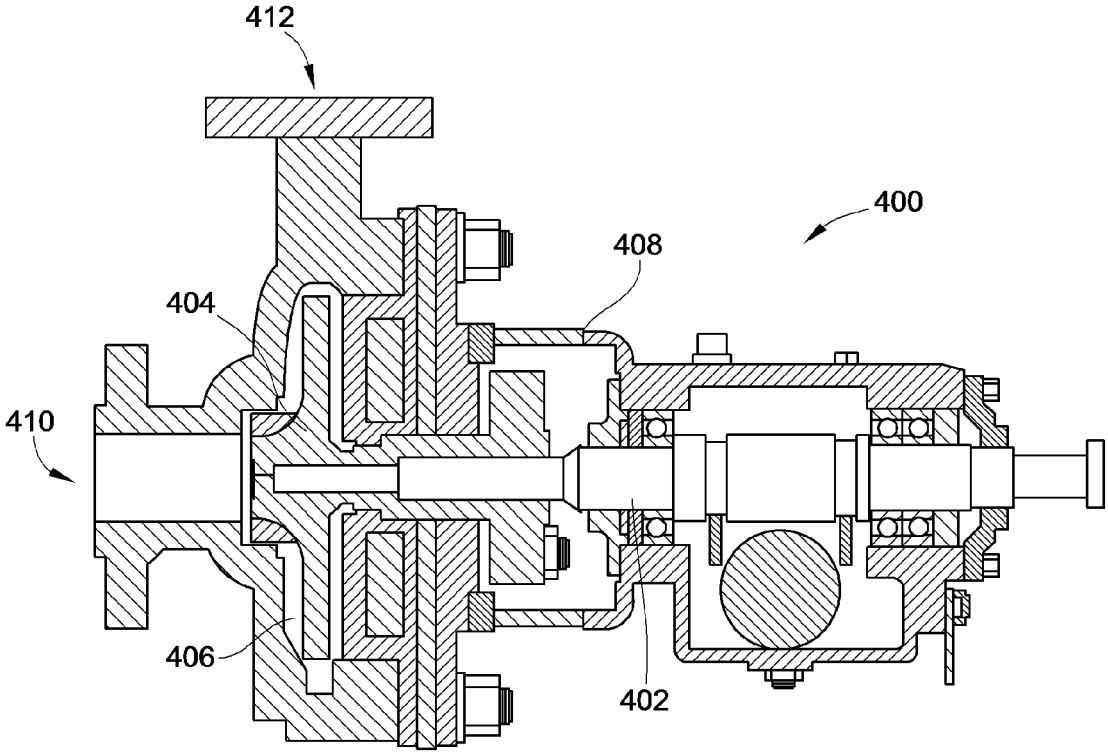
FIG. 10 is a cross-sectional view of a centrifugal pump that incorporates an embodiment of the invention.

FIG. 10 is a cross-sectional illustration of a centrifugal pump 400 that incorporates an embodiment of the invention. The pump 400 includes a driveshaft 402 which is configured to be rotated by a power source (not shown) at one end, and to an impeller 404 at the other end. The power source may be, for example, a motor, or a rotating shaft such as that on a jet engine. The impeller 404, which is disposed within a chamber 406 of a pump casing 408, is rotated by the driveshaft 402 during pump operation. The chamber 406 is connected to an inlet 410 and connected to an outlet 412. In operation, a fluid enters the chamber 406 via inlet 410. The fluid flows axially towards the impeller 404. The rotation of the impeller 404 propels the fluid radially towards the outlet 412.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An impeller for a centrifugal pump comprising:

a disk-shaped shroud having a central axis, a front surface, a rear surface, and a circular perimeter;

a hub at the center of the shroud, the hub having an axial bore;

a first plurality of vanes on the front surface of the shroud, the first plurality of vanes extending radially inward from the perimeter towards the hub;

a second plurality of vanes on the rear surface of the shroud, the second plurality of vanes extending radially inward from the perimeter towards the hub a balancing area on the rear surface of the shroud, the balancing area extending radially outward from the hub; and a plurality of openings in the shroud, the plurality of openings configured to allow a fluid to pass from one side of the shroud to the other.

2. The impeller of claim 1, wherein a diameter of the of the balancing area is defined by the inward extension of the second plurality of vanes.

3. The impeller of claim 1, wherein the plurality of openings comprises a plurality of circular openings.

4. The impeller of claim 3, wherein the plurality of circular openings comprises one or more circular openings having a first diameter, and one or more circular openings having a second diameter, wherein the first diameter is different from the second diameter.

5. The impeller of claim 3, wherein the plurality of circular openings is spaced symmetrically around the circumference of the shroud.

6. The impeller of claim 5, wherein at least one circular opening is located between each pair of adjacent vanes of the first plurality of vanes.

7. The impeller of claim 5, wherein the plurality of circular openings comprises a first group and a second group, wherein each circular opening in the first group is located in a first region and each circular opening in the second group is located in a second region, wherein the first region is farther from the axis than the second region.

8. The impeller of claim 7, wherein the number of circular openings in the second group is two thirds the number of circular openings in the first group.

9. The impeller of claim 1, wherein the plurality of openings comprises a plurality of radially-extending slotted openings.

10. The impeller of claim 9, wherein the diameter of the of the balancing area is defined by the inward extension of the slotted openings.

11. The impeller of claim 9, wherein at least one slotted opening is located between each pair of adjacent vanes of the first plurality of vanes.

12. The impeller of claim 9, wherein each of the plurality of radially-extending slotted openings is a curved slotted opening.

13. The impeller of claim 1, wherein each of the first plurality of vanes is curved.

14. The impeller of claim 13, wherein the plurality of vanes is evenly spaced around the circumference of the shroud.

15. The impeller of claim 14, wherein the plurality of vanes comprise a group of long vanes and a group of short vanes.

16. The impeller of claim 15, wherein the long vanes and short vanes are placed in an alternating sequence around the circumference of the shroud.

17. The impeller of claim 1, wherein each of the second plurality of vanes is curved.

18. The impeller of claim 1, wherein each of the first plurality of vanes extends in a direction substantially orthogonal to the front surface of the shroud, and wherein the degree of the extension defines the vane height.

19. The impeller of claim 18, wherein the height of each vane of the first plurality of vanes tapers linearly from a maximum height near the hub to a minimum height at the perimeter.

20. The impeller of claim 1, wherein each of the second plurality of vanes extends in a direction substantially orthogonal to the rear surface of the shroud.

21. The impeller of claim 1, wherein the balancing area, when subjected to a pressure from the fluid, develops a force in an axial direction that opposes another axial force acting on the impeller.

22. A centrifugal pump comprising:

a driveshaft configured to be rotated;

a pump casing comprising:

an inlet;

an outlet;

and a chamber disposed between the inlet and outlet;

an impeller disposed in the pump casing and attached to the driveshaft, the impeller comprising;

a circular shroud having an central axis, a front surface, a rear surface, and a circular perimeter;

an eye at the center of the shroud, the eye having an axial bore;

a first set of vanes on the front surface of the shroud, the first set of vanes extending radially inward from the perimeter towards the hub;

a second set of vanes on the rear surface of the shroud, the second set of vanes extending radially inward from the perimeter towards the hub;

a balancing region on the rear surface of the shroud, the balancing region extending radially outward from the hub; and a plurality of openings in the shroud, the plurality of openings configured to allow a fluid to pass from one side of the shroud to the other.

23. The centrifugal pump of claim 22, wherein, during pump operation, axial forces on the impeller from plug load at the inlet are opposed by pressure-induced forces resulting from the fluid acting on the balancing region.

24. The centrifugal pump of claim 22, wherein the surface area of the balancing region is defined by the inward extension of the second set of vanes.

25. The centrifugal pump of claim 22, wherein the surface area of the balancing region is defined by the proximity of the plurality of openings to the eye.

26. The centrifugal pump of claim 22, wherein each of the second set of vanes is curved.

27. The centrifugal pump of claim 22, wherein each of the first set of vanes is curved.

28. The centrifugal pump of claim 22, wherein the plurality of openings comprises a plurality of circular openings.

29. The centrifugal pump of claim 22, wherein the plurality of openings comprises a plurality of radially-extending slotted openings.

30. The centrifugal pump of claim 29, wherein each of the plurality of radially-extending slotted openings is a curved radially-extending slotted opening.

* * * * *